United States Patent [19]

Kuryluk

[11] Patent Number: 4,789,464

[45] Date of Patent: Dec. 6, 1988

[54] MINERAL SEPARATOR

[76] Inventor: Michael H. Kuryluk, Comp 109 Lakeview Ave., Lr. Sackville, Halifax, N.S. B4C 3B1, Canada

[21] Appl. No.: 87,301

[22] Filed: Aug. 20, 1987

[51] Int. Cl.[4] ..... B03B 5/68

[52] U.S. Cl. ..... 209/161; 209/461; 73/32 R

[58] Field of Search ..... 209/13, 17, 18, 158, 209/159, 160, 161, 461; 73/32 R, 61.4

[56] References Cited

U.S. PATENT DOCUMENTS

| | | | |
|---|---|---|---|
| 785,819 | 3/1905 | Michaelsen | 209/465 |
| 980,244 | 1/1911 | Ginivin | 209/159 |
| 1,429,480 | 9/1922 | Allen | 209/158 |
| 1,483,371 | 2/1924 | Miller | 209/158 |
| 2,151,322 | 3/1939 | Green | 209/465 |
| 2,519,781 | 8/1950 | Morris | 209/159 |
| 2,906,401 | 9/1959 | Katz | 209/159 |
| 3,550,773 | 12/1970 | Villani et al. | 209/158 |
| 3,642,129 | 2/1972 | McDaniel et al. | 209/159 |
| 3,869,903 | 3/1975 | Beach et al. | 209/160 |
| 4,222,860 | 9/1980 | Park | 209/465 |
| 4,554,066 | 11/1985 | Tarbitt et al. | 209/3 |

FOREIGN PATENT DOCUMENTS

| | | | |
|---|---|---|---|
| 1134641 | 6/1958 | Fed. Rep. of Germany | 209/158 |
| 171266 | 11/1921 | United Kingdom | 209/160 |

*Primary Examiner*—Kenneth M. Schor
*Assistant Examiner*—Thomas M. Lithgow
*Attorney, Agent, or Firm*—Stevens, Davis, Miller & Mosher

[57] ABSTRACT

An apparatus is disclosed for gravity separation of comminuted solid particles. It has a transparent pipe (18) through which water flows upwards at a controlled velocity to float grains of a given size and specific gravity but to maintain lighter particles in a funnel on top of the pipe. The pipe is enclosed in a housing in which a water level can be raised or lowered to coincide with a mark on a scale indicative of the instant lowermost gravity of particles passing downwards through the pipe (18). The device is of a simple structure and provides the possibility of the readout of the specific weight of the accepted particles.

3 Claims, 1 Drawing Sheet

MINERAL SEPARATOR

BACKGROUND OF THE INVENTION

The present invention relates to the art of hydraulic mineral separators of the type utilizing an upright pipe through which water flows at a controlled velocity in order to allow relatively heavy particles of a treated mixture to slowly drop to the lower part of the tube or pipe, while forcing lighter particles upwardly and away from the apparatus.

Separating devices of this type have long been known. Reference may be had, for instance, to U.S. Pat. No. 1,483,371 issued to Joseph B. Miller on Feb. 12, 1924. The apparatus shown therein has several disadvantages. It does not have any means that would facilitate the viewing of the particles, (usually very small or comminuted particles) in the upright pipe thus making it difficult to properly adjust the velocity of flow of water through the pipe. The arrangement of the entire device inclusive the container for collecting accepted particles, i.e. the heaviest fraction, is entirely enclosed and thus impossible to operate in a continuous manner. Thirdly, there is no practical means for readily designating the gravity or specific weight of the particles accepted by the apparatus.

SUMMARY OF THE INVENTION

The object of the present invention is to further advance the art of hydraulic mineral separators of the above type.

In general terms, the present invention provides apparatus for gravity separation of small solid particles having a generally uniform grain size and surface roughness but different specific weight, said apparatus comprising, in combination: a normally generally upright, transparent pipe open at both ends and provided, at the upper end, with a funnel, a normally generally upright, transparent housing closed on top and enclosing said pipe, the housing having a lower end provided with a discharge opening disposed at a level below that of the lower end of the said pipe, pipe securement means for maintaining said pipe within said housing, an overflow discharge operatively associated with said funnel, stirring means for maintaining a mixture of the particles supplied to the funnel in a generally suspended state, and water supply means for supplying a controlled flow of water into said housing, the cross-sectional area of said discharge opening being smaller than that of the opening at the lower end of said pipe.

BRIEF DESCRIPTION OF THE DRAWINGS

The invention will now be disclosed in greater detail by way of an exemplary embodiment with reference to the accompanying drawing, wherein.

DETAILED DESCRIPTION

Figure 1:
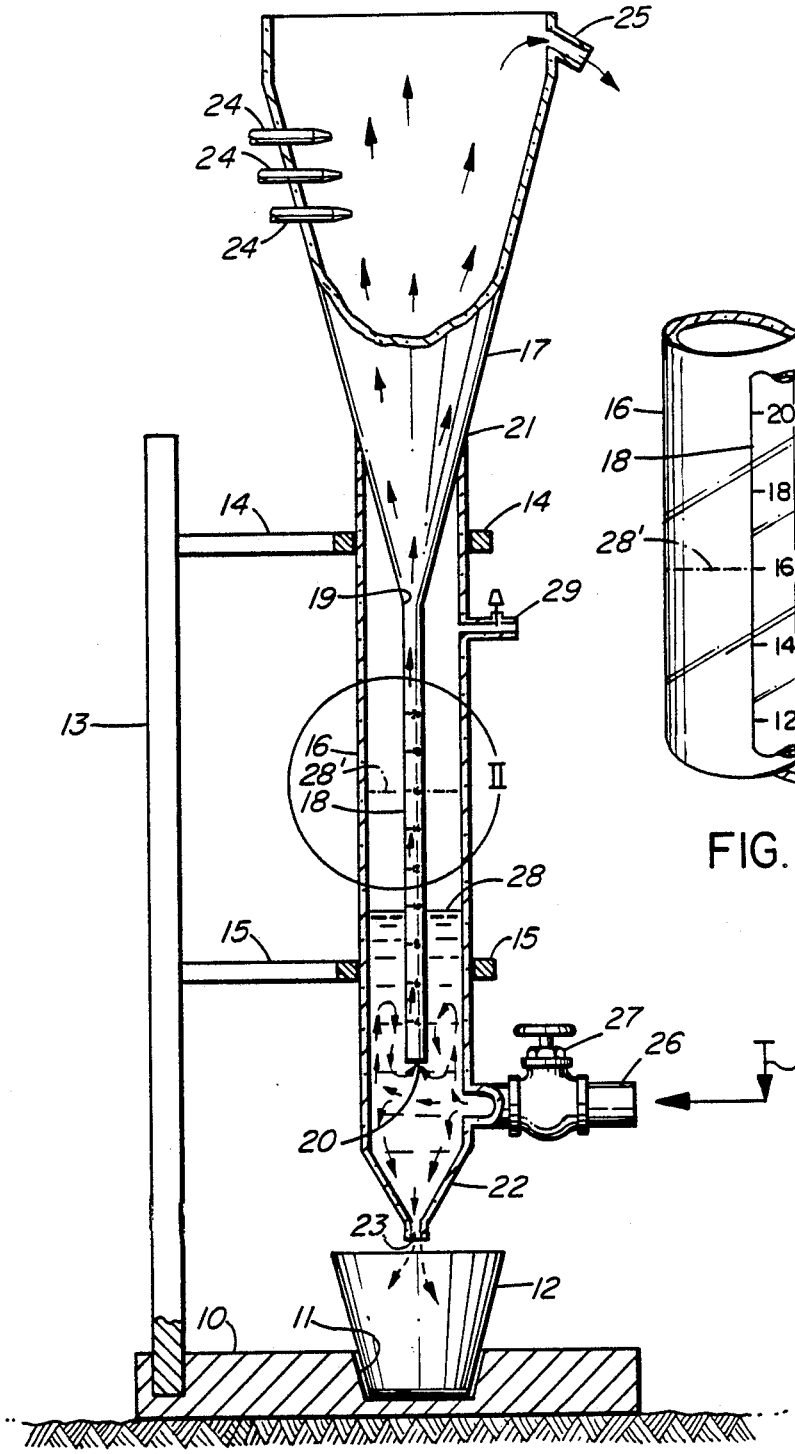
FIG. 1 is a diagrammatic representation showing the device in a generally vertical cross-section.
Figure 2:
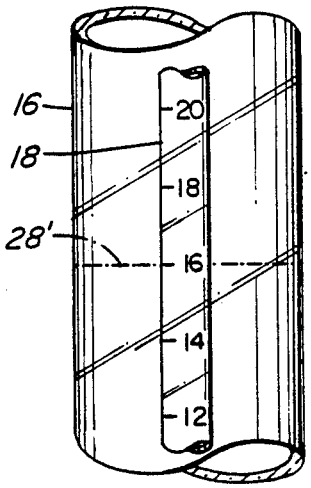
FIG. 2 is detail II of FIG. 1, on an enlarged scale.

The shown exemplary embodiment has a base 10 provided with an opening 11 receiving a container 12 for accepted material. The base 10 is provided with a column 13 having two generally horizontal mounting brackets 14, 15. The mounting brackets 14, 15 support a normally generally upright, cylindric housing 16 which is made of a transparent material, in the shown embodiment, glass.

The cylindric glass housing has an outside diameter of approximately 3". The overall height of the entire apparatus is about 31". The upper portion of the housing 16 is closed by being sealingly connected to a funnel 17, the lower end of which merges with a normally generally upright, transparent pipe 18. Thus, the funnel 17 and the pipe 18 combine to form a part which is also referred to as "inner conduit means". The pipe 18 is open at its upper end 19 and also at its lower end 20. The pipe 18 is of a generally uniform, circular cross-sectional configuration, being made of a cylindric glass of outside diameter of about ⅜", the thickness of the wall of the pipe 18 being about 1/16". The sealed joint between the funnel 17 and the housing 17 is designated with reference numeral 21. The housing 16 is thus closed at its top.

The joint 21, which can be of many different types, for instance an O-ring adhesively secured about the housing 16 and the funnel 17, thus forms an embodiment of what is generally referred to as "pipe securement means for maintaining the pipe 18 within the housing 16". At the lower end of the housing, the body of the housing tapers at 22 and terminates at a discharge opening 23, the cross-sectional configuration of which is substantially smaller than that of the lower entrance to the upright pipe 18 at 20.

The funnel 17 is provided with three jets 24 arranged tangentially and adapted to maintain the material contained in the funnel 17 in a stirred or generally suspended state so that the particles of a comminuted mixture or the like can separate from each other within the area of the funnel. Reference numeral 25 designates an overflow for discharge of light fraction of the mixture processed by the apparatus. A water supply pipe 26 is provided at the lower end of housing 16. It is equipped with a flow control valve 27. The upstream end (not shown) of the pipe 26 is connected to a source of static water pressure, for instance to an upstream section of a creek in the area of prospecting. Depending, among other variants, on the hydrostatic pressure P and the degree of opening of the valve 27, process water is allowed to enter the lower part of the housing 16 and reaches an exemplary operational level 28. This assumes, of course, that the process water continuously flows through the water supply pipe 26 and the flow control valve 27 into the lower part of the housing 16 and therefrom through the upright pipe 18 into the funnel 17 and away from same through the overflow 25. A substantially smaller portion of the volume of water incoming through 26 and 27 is discharges at 23 into the container 12, together with separated heavy particles of the process mixture, as will be described later. In the upper part of the housing 16 is provided an air valve 29. It is located above the highest practical level of water in the housing 16. It will be explained later that the level 28 can be artificially brought to virtually any height of the upright pipe 18.

The upright pipe 18 is provided with a scale having a plurality of marks. The marks 20 and 4 designate the uppermost and the lowermost practical or operational level of the device as it will be referred to hereinafter.

In operation, the device is started by opening the valve 27 after having connected the water supply pipe 26 to a suitable source of static water pressure. The jets 24 are connected to a source of process water. With respect to the jets 24, it will suffice to say that the intensity of flow of water through same is maintained such as to retain sufficient stirring effect within the funnel 17. The air valve 29 is now closed and the static pressure P results in the water level 28 reaching the height as shown in the drawing. The water now flows through the pipe 18, funnel 17 and over the overflow 25. A minor volume of water is discharged through the passage 23 into the container 12. When the container 12 is full, the water simply overflows to the ground.

A specimen of a known specific weight is now dropped into the funnel. With the flow of water through the pipe 18 being relatively slow the specimen begins to travel downwards. At the time of its passage through the upright pipe 18, the speed of the flow of water within the pipe 18 is increased by opening the valve 27 until the specimen is suspended and only very slowly travels down through the pipe 18. Eventually, it is discharged at 20, falls into the lower part of the housing 16 where the flow of water is much slower than in the pipe 18 and eventually drops through the opening 23 into the container 12. Assuming that the specific weight of the known sample is, say, 16, it is now desirous to mark the instant specific weight to show the instant setting of the apparatus. This can be conveniently done by raising the level 28 up to the mark 16 (level 28 in FIG. 1) by opening the air valve 29 with the result that the housing 16 begins to fill in with water. When the level 28 reaches the mark 16 (i.e. 28'), the valve 29 is closed again. The apparatus is now ready for operation and is also provided with an indication for the operator of the specific weight of the lightest particles still separated from the mixture in the funnel 17. Particles having specific weight of less than 16 are prevented from entering the pipe 18 due to the flow speed therein. The heavier particles fall down the pipe 18.

If it is desired to lower the level 28 for the purpose of marking a lower specific weight, the flow of water through valve 27 is first throttled, with air valve 29 open. This will result in the drop of level 28. When the level reaches approximately the level of the inlet of pipe 26 into the housing 16, the air valve 29 is closed. With the increased opening of valve 27, the flow through the pipe 18 is increased again, but the level 28 remains generally at a low mark of the scale. When the flow in pipe 18 reaches the value required for the separation of a new, lighter specimen, the level 28 can now be raised again to coincide with the appropriate level mark on the scale of pipe 18. The distance between the level of the inlet of pipe 26 into the housing 16 and the level of opening 20 in pipe 18 is such that the minimum flow at which the opening 20 is still submerged is capable of maintaining a specimen having a particular grain size and specific weight of 4 float in the upright pipe 18. Accordingly, the calibration is always done by raising the level 28 by suitable operation of the valve 27.

Since both the wall of the housing 16 and of the pipe 18 are transparent, they combine to provide an effect of optical magnification of the particles contained in the pipe 18, thus further facilitating the calibration and operation of the device.

The device is of a simple structure. It is capable and has been successfully tested in field application in prospecting, where gravity separation of different particles often has to be done under rugged conditions without the use of the usual separation plant facilities.

The fact that the device has to be recalibrated every time the equipment is started up again does not pose undue difficulties as the operation of the calibrated device is continuous and is normally carried out for an extended period of time.

Those skilled in the art will appreciate that many details of the shown arrangement can be modified. For instance, the feeding funnel 17 is only one of processed material supply means and can be replaced by many other designs, for instance by a stirring chamber as shown in the above U.S. Pat. No. 1,483,371. The scale does not have to be on the inner pipe 18 and can be provided on the wall of the housing 16. These are just two of many other modifications which differ from the described embodiment without departing from the invention.

Accordingly, I wish to embody within the scope of the patent issued on the present application not only the shown embodiment but all such embodiments as reasonably and properly come within the scope of my contribution to the art.

I claim:

1. Apparatus for gravity separation of small solid particles having a generally uniform grain size and surface roughness but different specific weight, said apparatus comprising, in combination:

(a) a generally upright inner conduit means comprised of (i) a transparent pipe open at both ends, and (ii) a funnel, said funnel being connected with the pipe at the upper end of the latter and forming an upwardly and outwardly directed extension thereof;

(b) a generally upright, transparent housing, the housing having a lower portion surrounding the lower end of the pipe and provided with a discharge opening disposed at a level below that of the lower end of said pipe, and the housing having an upper portion which is extended to contact the inner conduit means such that the housing upper portion encloses the inner conduit means at a point intermediate the upper end of the inner conduit means and the lower end of said pipe;

(c) pipe securement means for maintaining said pipe within said housing;

(d) an overflow discharge operatively associated with said funnel;

(e) stirring means for maintaining a mixture of the particles contained in the funnel in a suspended state;

(f) water supply means for supplying a controlled flow of water into said lower portion of said housing;

(g) the cross-sectional area of said discharge opening being smaller than that of the opening at the lower end of said pipe;

(h) said housing having air valve means disposed at a level above a predetermined uppermost operational level of water in said housing.

2. Apparatus as claimed in claim 1, proivded with a generally vertical scale with a plurality of marks indicative of the water level in said housing, said marks being disposed one above the other and being designated with different numerals corresponding to specific gravity of particles to be accepted by the apparatus.

3. Apparatus as claimed in claim 2, wherein the scale is on said transparent pipe.

* * * * *